US007965241B2

(12) United States Patent
Marquis

(10) Patent No.: US 7,965,241 B2
(45) Date of Patent: Jun. 21, 2011

(54) DEVICE FOR COUPLING BETWEEN A PLASMA ANTENNA AND A POWER SIGNAL GENERATOR

(75) Inventor: Emmanuel Marquis, Bullion (FR)

(73) Assignee: Thales (FR)

( * ) Notice: Subject to any disclaimer, the term of this patent is extended or adjusted under 35 U.S.C. 154(b) by 393 days.

(21) Appl. No.: 12/278,283

(22) PCT Filed: Feb. 7, 2007

(86) PCT No.: PCT/EP2007/051177

§ 371 (c)(1),
(2), (4) Date: Aug. 5, 2008

(87) PCT Pub. No.: WO2007/090850

PCT Pub. Date: Aug. 16, 2007

(65) Prior Publication Data

US 2009/0015489 A1 Jan. 15, 2009

(30) Foreign Application Priority Data

Feb. 7, 2006 (FR) ..... 06 01075

(51) Int. Cl.
*H01Q 1/26* (2006.01)

(52) U.S. Cl. ..... 343/701; 250/348

(58) Field of Classification Search ..... 343/701; 250/348
See application file for complete search history.

(56) References Cited

U.S. PATENT DOCUMENTS

| | | | | |
|---|---|---|---|---|
| 3,404,403 | A | 10/1968 | Vallese et al. | |
| 6,087,993 | A | 7/2000 | Anderson et al. | |
| 6,169,520 | B1 | 1/2001 | Anderson | |
| 6,710,746 | B1 * | 3/2004 | Anderson et al. | 343/701 |
| 6,842,146 | B2 * | 1/2005 | Alexeff et al. | 343/701 |

FOREIGN PATENT DOCUMENTS

| | | | |
|---|---|---|---|
| EP | 1338674 | A1 | 8/2003 |
| EP | 1524721 | A2 | 4/2005 |
| FR | 2863782 | A1 | 6/2005 |
| GB | 1128881 | | 10/1968 |

* cited by examiner

*Primary Examiner* — Tan Ho
(74) *Attorney, Agent, or Firm* — Lowe Hauptman Ham & Berner, LLP

(57) ABSTRACT

The present invention relates to a device for coupling between a plasma column serving as an antenna and an electric power signal generator, associated with a laser. This device comprises at least two conducting electrodes, each pierced with a hole, these holes being coaxial, the electrodes being connected on the one hand to a high voltage direct current source and on the other hand to power signal alternating current source, the laser(s) being placed do that its (their) beam arrives along the axis of said holes of the electrodes.

6 Claims, 6 Drawing Sheets

DEVICE FOR COUPLING BETWEEN A PLASMA ANTENNA AND A POWER SIGNAL GENERATOR

CROSS REFERENCE TO RELATED APPLICATIONS

The present Application is based on International Application No. PCT/EP2007/051177, filed on Feb. 7, 2007, which in turn corresponds to French Application No. 0601075 filed on Feb. 7, 2006, and priority is hereby claimed under 35 USC §119 based on these applications. Each of these applications are hereby incorporated by reference in their entirety into the present application.

FIELD OF THE INVENTION

The present invention relates to a device for coupling between a plasma antenna and a power signal generator and a method for using a plasma antenna comprising such a coupling device.

DESCRIPTION OF RELATED ART

Conventional (metal) wireless antenna usually operate in a narrow frequency band, and their dimensions are inversely proportional to the operating wavelength. In the low frequency (L.F.), and very low frequency (V.L.F.) and extremely low frequency (E.L.F.) domains, the height of the antennas of the quarter-wave type should reach several hundreds of meters to several hundreds of kilometers (for example 750 m to 100 kHz), which makes them very difficult to construct or even unrealizable. In addition, they can in no circumstances be easily moved. These frequency domains are used notably for communications with submarines when on a dive.

To solve these problems, it is known practice to use antennas called "plasma antennas", for example according to U.S. Pat. No. 3,404,403. This patent describes a plasma antenna comprising a pulse laser source, means for focusing the laser beam on different points in order to ionize a column of air and means for coupling a signal to the base of the ionized air column, this column serving as a radiating element in order to transmit and/or receive a wireless signal. Also known are plasma antennas according to U.S. Pat. No. 6,087,993 and patent FR 2 863 782. In the first document, the antenna is made movable and the length of the column of ionized air is reduced by modulating the excitation current of the ionization generator and by concentrating the production of electrons in at least one portion of this column. In the second, a femtosecond laser is used to generate a filament in the ionized air column.

The plasma antennas described in these documents and operating by ionization of air are stealthy and require no infrastructure, unlike conventional antennas. However, in all these known plasma antennas, the coupling between the plasma column and the electric power generator which generates the signal to be transmitted is not optimized. Specifically, for example, the abovementioned French patent describes a capacitive (of the order of a few pF) or inductive coupling device whose impedance is very low, which markedly degrades the transfer of power between the electric generator and the antenna.

SUMMARY OF THE INVENTION

One object of the present invention is a device for coupling between a plasma column serving as an antenna and a power signal generator, a device which allows a very good transfer of power between the electric generator and the plasma column when the latter is formed. A further object of the present invention is an antenna using such a device, an antenna that is able to operate at very low frequencies. Another object of the present invention is a method for forming a plasma column for the purpose of constructing an antenna.

The coupling device according to the invention is associated with at least one laser and it is characterized in that it comprises at least two conducting electrodes each pierced with a hole, these holes being coaxial, the electrodes being connected on the one hand to a high voltage direct current source and on the other hand to a power signal generator, the laser(s) being placed so that its (their) beam arrives along the axis of said holes of the electrodes.

Still other objects and advantages of the present invention will become readily apparent to those skilled in the art from the following detailed description, wherein the preferred embodiments of the invention are shown and described, simply by way of illustration of the best mode contemplated of carrying out the invention. As will be realized, the invention is capable of other and different embodiments, and its several details are capable of modifications in various obvious aspects, all without departing from the invention. Accordingly, the drawings and description thereof are to be regarded as illustrative in nature, and not as restrictive.

BRIEF DESCRIPTION OF THE DRAWINGS

The present invention is illustrated by way of example, and not by limitation, in the figures of the accompanying drawings, wherein elements having the same reference numeral designations represent like elements throughout and wherein.

DETAILED DESCRIPTION OF THE INVENTION

The present invention is described below with reference to the creation of an ionized air column, and it is well understood that the ionization of this column may be reduced to a filament ionization at the axis of symmetry, as described in the abovementioned French patent, when a laser of the femtosecond type is used. It is also well understood that the preferred embodiment of the device of the invention, as described below, comprises two electrodes pierced with coaxial holes, but the device of the invention may comprise a higher number of electrodes. The device described below is represented in a position oriented so that the plasma column that it allows to be created is vertical, but it is well understood that this device may have any other orientation so that the antenna is for example horizontal. The plasma antenna obtained according to the invention is described in this instance as a transmission antenna, but it is well understood that it may also be used for reception, provided, naturally, that the low or very low frequency generator described below is kept connected.

Figure 1:
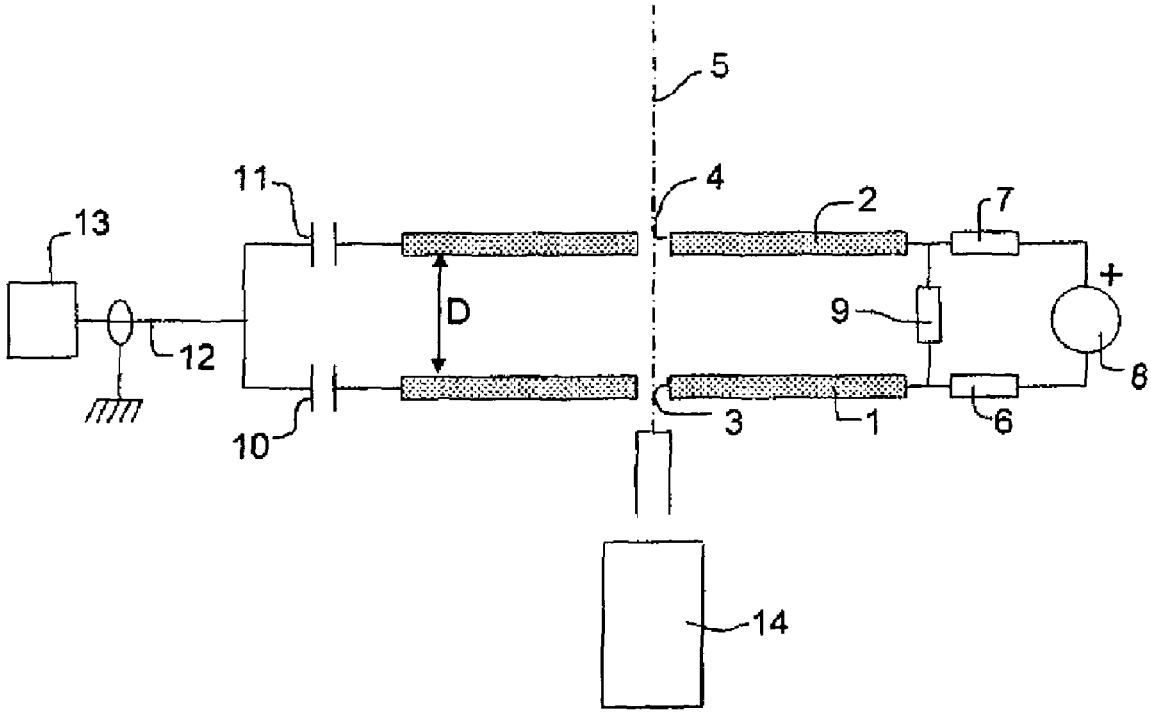
FIG. 1 is a simplified diagram of a device according to the invention for the creation of a plasma antenna.

The device represented in FIG. 1 comprises two metal plates 1, 2 forming electrodes and each pierced with a hole 3, 4 respectively, the two holes being coaxial, their common axis being referenced 5. The shape of these electrodes is not critical. They may for example be circular or polygonal. The holes 3 and 4 are preferably pierced in the center of these electrodes.

The electrodes 1 and 2 are connected on the one hand via ballast resistors 6, 7 respectively to a high voltage source 8, a resistor 9 being connected between the two electrodes, at their junction with the resistors 6 and 7. In the following figures, this resistor 9 is not represented, but it is well understood that it may be present. The positive pole of the source 8 is preferably connected to the electrode 2 (in particular when these electrodes are placed horizontally and at a short distance from the ground). On the other hand, the electrodes 1 and 2 are connected via direct current isolation capacitors 10, 11 respectively and a line 12, preferably coaxial, to a low power or very low frequency and high peak voltage transmitter 13, which may be close to or far from the electrodes 1, 2 of the antenna. The shielding of the line 12 is connected to the ground. The distance D between the electrodes 1 and 2 is a function of the value of the high voltage of the source 8. Generally, this distance D must be greater than the breakdown distance between the electrodes in an ambient environment in the absence of a plasma column, and be less than the breakdown distance between the electrodes in the presence of the plasma column.

A priming laser 14 is placed beneath the electrode 1, so that the axis of the beam that it produces is indistinguishable from the axis 5 at least just before reaching the electrode 1. Therefore, if it is desired to place the laser 14 so that its output axis is horizontal, the user then has a mirror that returns its output beam along the axis 5. It is also possible to place a semitransparent mirror on the axis 5 if it is desired to use two lasers. It is possible to use two lasers for example, dedicating one of them to firings and the other to the maintenance of the ionized column forming an antenna.

According to typical embodiments of the invention, in no way limiting, the electrodes 1 and 2 are circular and have a diameter from a few tens of cm to several meters, their distance D from one another is from approximately 50 cm to 1 m, the diameter of the holes 3 and 5 is approximately 1 cm. The voltage of the source 8 is from approximately 10 to 20 kV, and the power supplied by the transmitter 13 may lie between a few hundred watts and a few mW. The average power that it delivers must be sufficient to maintain the plasma generated by the high voltage source 8.

Figure 5:
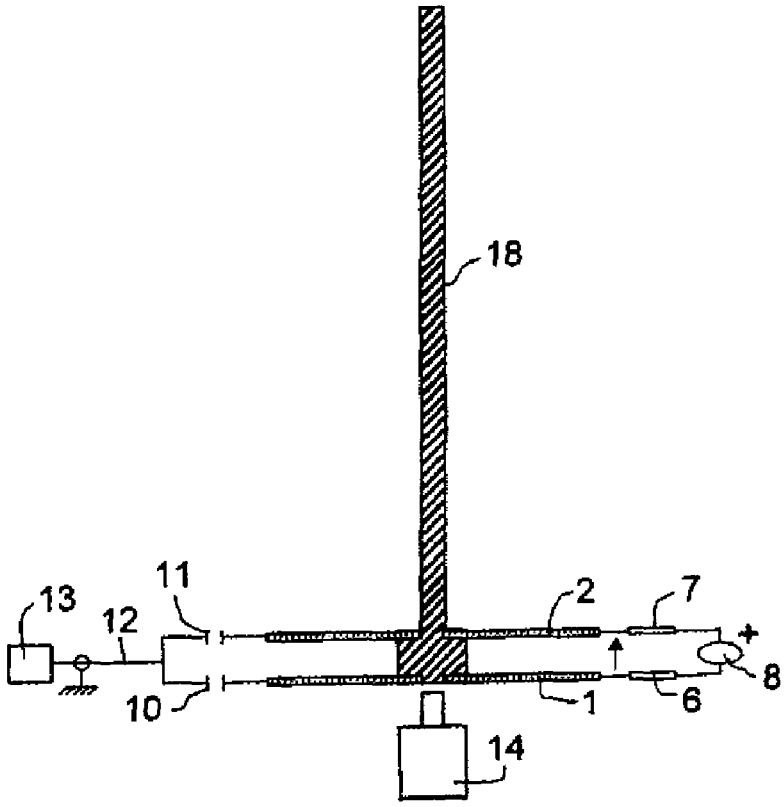
Figure 6:
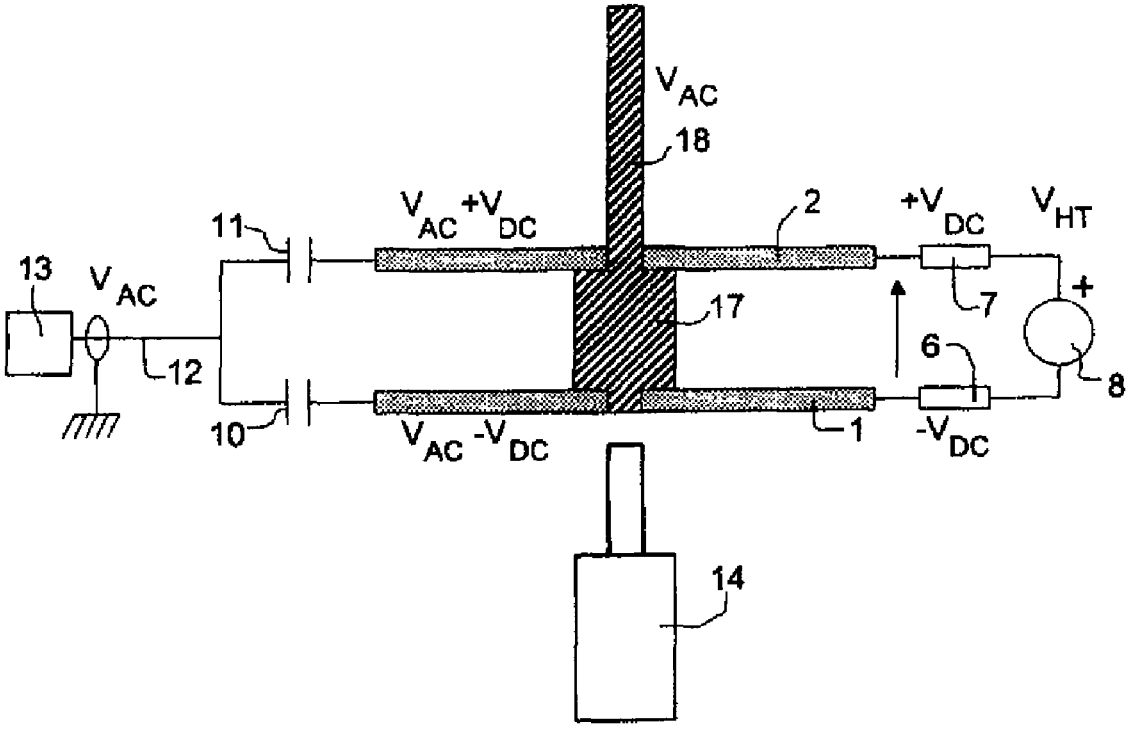
Figure 7:
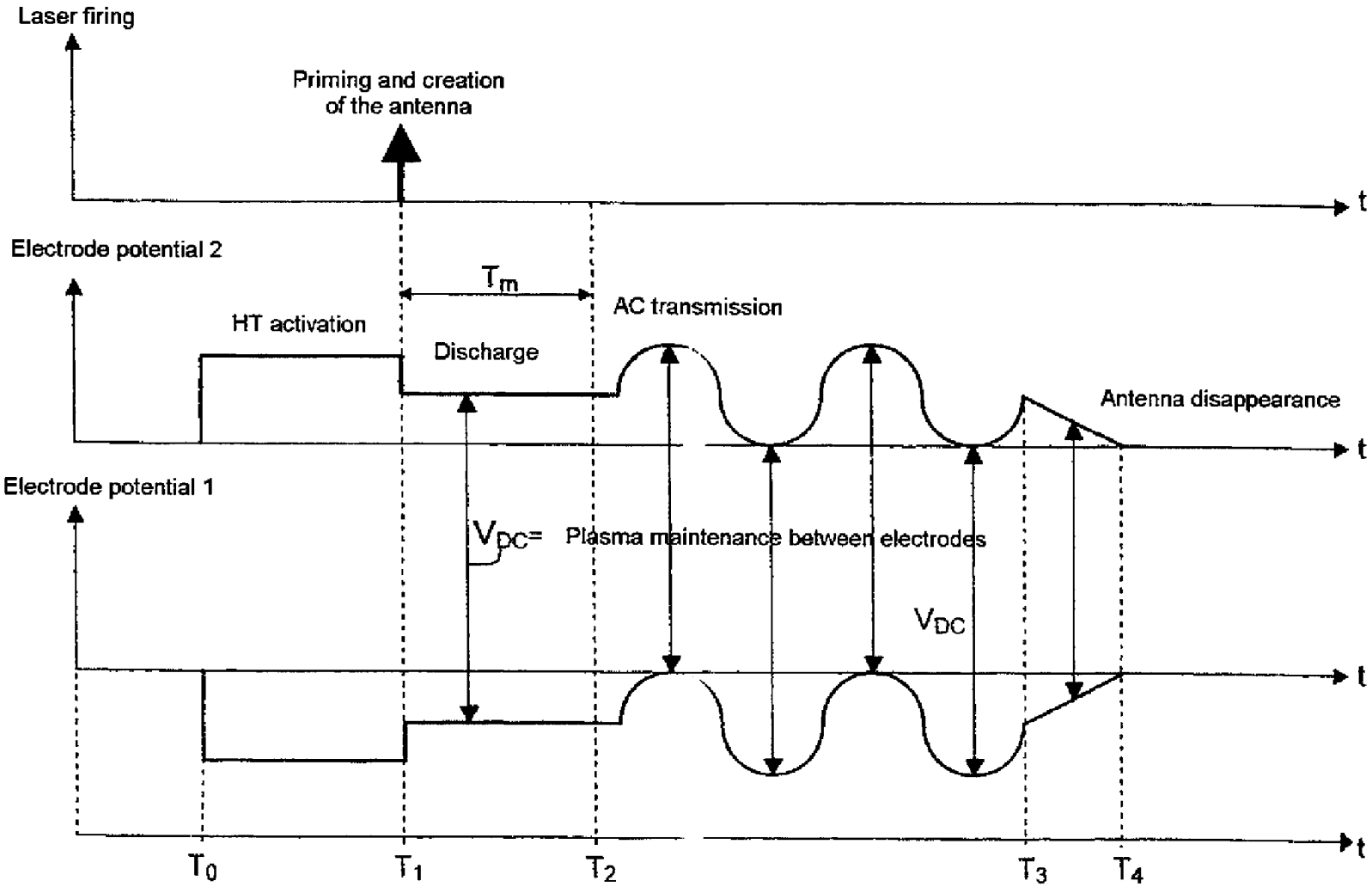
FIG. 7 is a simplified timing chart illustrating the phases of implementing FIGS. 2 to 6.

First of all, with the aid of the diagram of FIG. 6 and the timing chart of FIG. 7, the various successive phases of the creation of a plasma antenna with the aid of the device of the invention will be presented, in the case of a single firing of the laser 14. Then, with reference to FIGS. 2 to 6 and the timing chart of FIG. 9, the various steps of the formation of the plasma antenna will be explained in the case of two firings of the laser 14. For reasons of presenting the explanations, these phases are explained consecutively, but it is well understood that these phases may actually be simultaneous or virtually simultaneous.

It is assumed that initially none of the elements 8, 13 and 14 is activated. To illustrate the chronology of the various phases, reference will be made to the time references T0 to T4 of the timing chart of FIG. 7.

At the moment T0, the high voltage source 8 is activated.

At the moment T1, the laser 14, focused on the axis 5, beyond the electrode 2 is fired. This firing simultaneously produces a discharge between the electrodes 1 and 2 (ionized air column 17 between these electrodes) and the formation of an ionized column 18, thinner than the column 17, centered on the axis 5.

At the moment T2, the generator 13 is activated which injects power into the "virtual" antenna which is constituted by the plasma columns 17 and 18 and which maintains the ionization of these columns, because, as illustrated in FIG. 7, the instantaneous potential difference $V_{DC}$ between the electrodes 1 and 2 is constant from the moment T1 (see the relations below). It will be noted that it is necessary to observe a minimal time (typically of the order of a few tens of nanoseconds) between the moments T1 and T2 so that the plasma column is well established between the electrodes 1 and 2.

The signal delivered by the transmitter 13 may be written in the following form:

$$V_{AC}=A\cos(\omega t),$$

while the voltage applied by the source 8 to the electrodes 1 and 2 is in the form $-/+V_{DC}$.

The instantaneous potentials of the electrodes 1 and 2 are in the following form:

$$V_{E1}=V_{AC}-V_{DC}$$

$$V_{E2}=V_{AC}+V_{DC}$$

which means that there is constantly the same potential difference between the electrodes 1 and 2.

In the transmission regime, the electrodes 1 and 2 being taken to the same alternating current potential, there is no loss of alternating current power, this power being injected virtually entirely into the plasma antenna and contributing to maintaining the plasma.

At the end of the transmission (T3), the signal of the transmitter 13 being suppressed, the ionized column 18 forming the antenna disappears rapidly (between T3 and T4), and thereby the antenna disappears.

Figure 8:
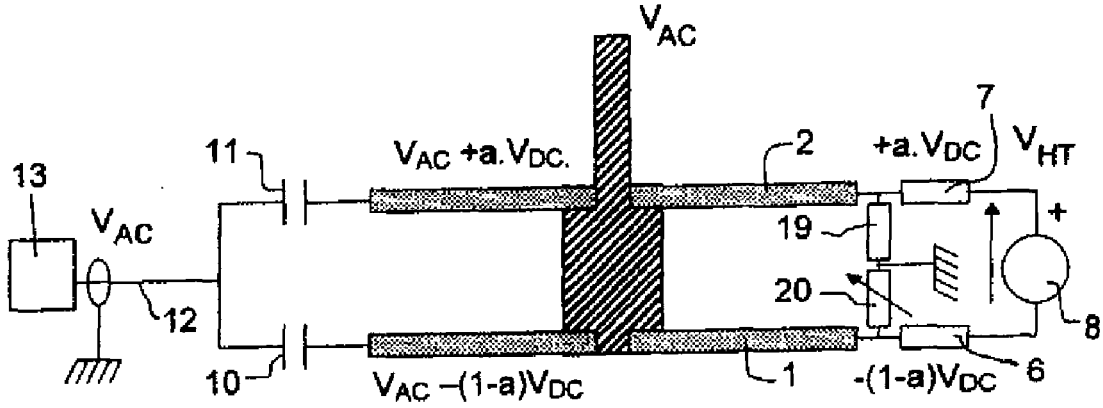
FIG. 8 is a simplified diagram of a variant of the device of the invention.

FIG. 8 represents a variant of the device of FIGS. 1 to 6. In this FIG. 8, the same elements as those of FIGS. 1 to 6 are allocated the same reference numbers. In this device of FIG. 8, in order to introduce an asymmetry of direct current potential between the electrodes 1 and 2, a potentiometric assembly formed for example by a fixed resistor 19 in series with a variable resistor 20 is used instead of the resistor 9 of FIG. 1, these two resistors being connected between the electrodes 1 and 2, their common point being connected to ground. The setting of the potentiometer thus formed allows a fine tuning of the potentials applied to the electrodes 1 and 2 in order to compensate for the losses of direct current absorbed by the conducting plasma antenna. Specifically, the leakage resistance on the side of the electrode 2 is weaker.

Figure 2:
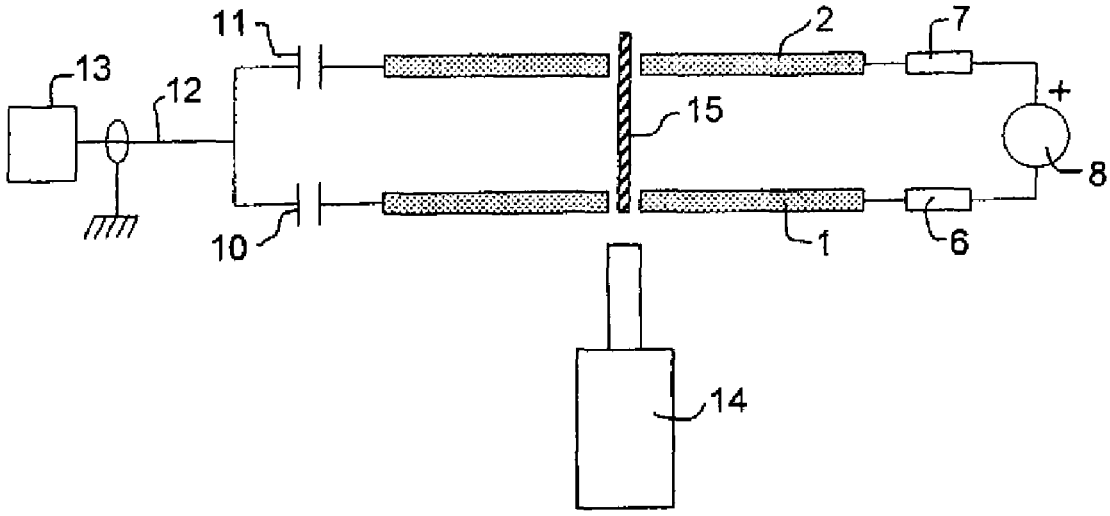
FIGS. 2 to 6 are simplified diagrams of the device of FIG. 1 showing the various successive phases of an exemplary embodiment of the invention for the creation of a plasma antenna.

As a variant of the invention (see the timing chart of FIG. 9), after the activation of the high voltage source (T0), a first laser firing (T1) is made, focused on the axis 5 between the two electrodes, then a second laser firing (T2) focused on the same axis 5, but beyond the electrode 2, and then the generator 13 (T3) is activated. The plasma antenna disappears (T5) shortly after the end of the activation of the generator 13 (T4). In detail, the various steps of this method are as follows:

FIG. 2: after the high voltage source 8 has been activated (T0), the laser 14 is activated (T1) in order to make a first "firing" focused on the axis 5, between the electrodes 1 and 2, in order, by high voltage discharge, to create a thin column of conducting plasma 15 between these two electrodes.

Figure 3:
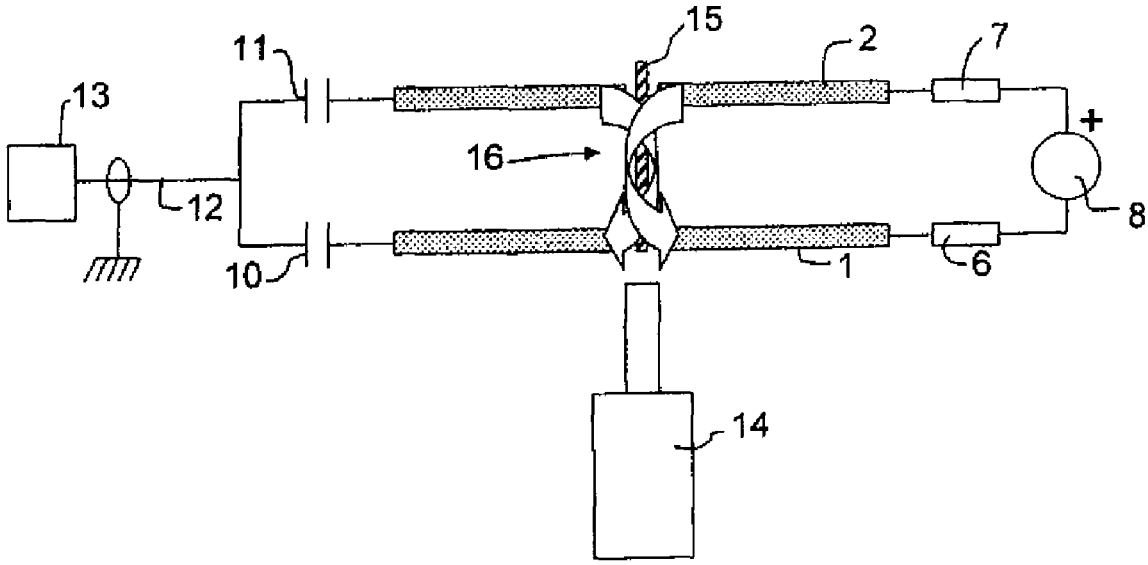

FIG. 3: the laser firing causes the high voltage discharge 16 in the plasma column 15, between the electrodes 1 and 2.

Figure 4:
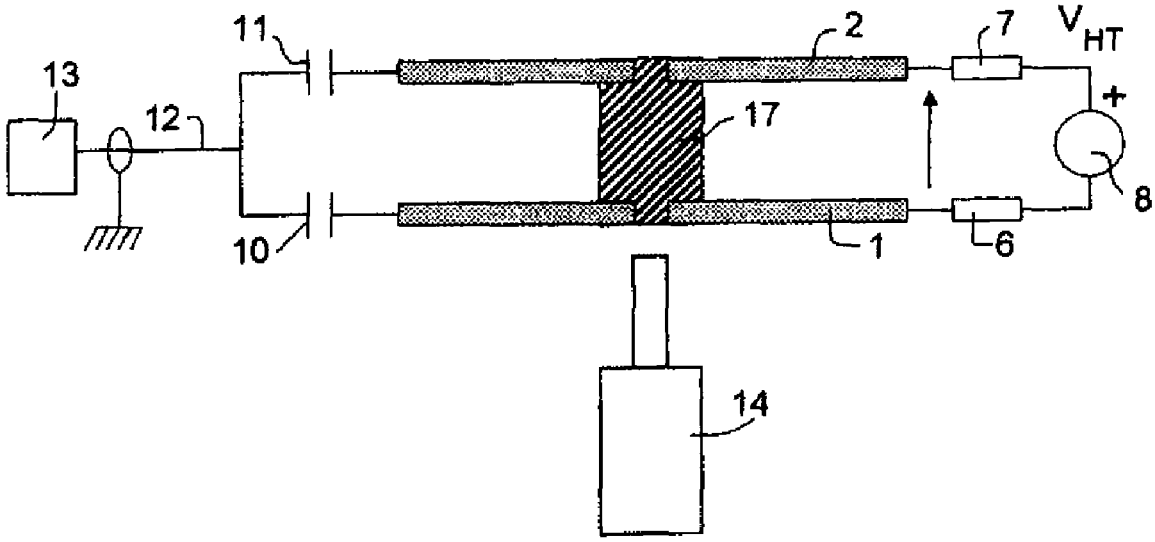

FIG. 4: The discharge 16 has the effect of broadening the conducting plasma column between the electrodes 1 and 2, the broadened column being referenced 17. It will be noted that after the creation of the plasma antenna, it is possible to short circuit the capacitors 10 and 11, and to do so up to the end of the use of the plasma antenna. The role of the high voltage generator 8 is then to maintain the ionized column 17 that has been made conducting. It will be noted that the phenomena illustrated in FIGS. 2 to 4 are practically simultaneous and have been broken down in order to make them easier to describe.

FIG. 5: A second firing of the laser 14 (T2), is made, focused on the axis 5, beyond the electrode 2. This second firing causes the formation of a plasma column 18 in continuity of electric conduction with the column 17. Because the laser 14 is preferably of the femtosecond type, the column 18 then reduces to plasma filaments, as described for example in the abovementioned French patent, and its length may reach several km, which gives it the characteristics necessary for a low (or very low) frequency antenna.

Figure 9:
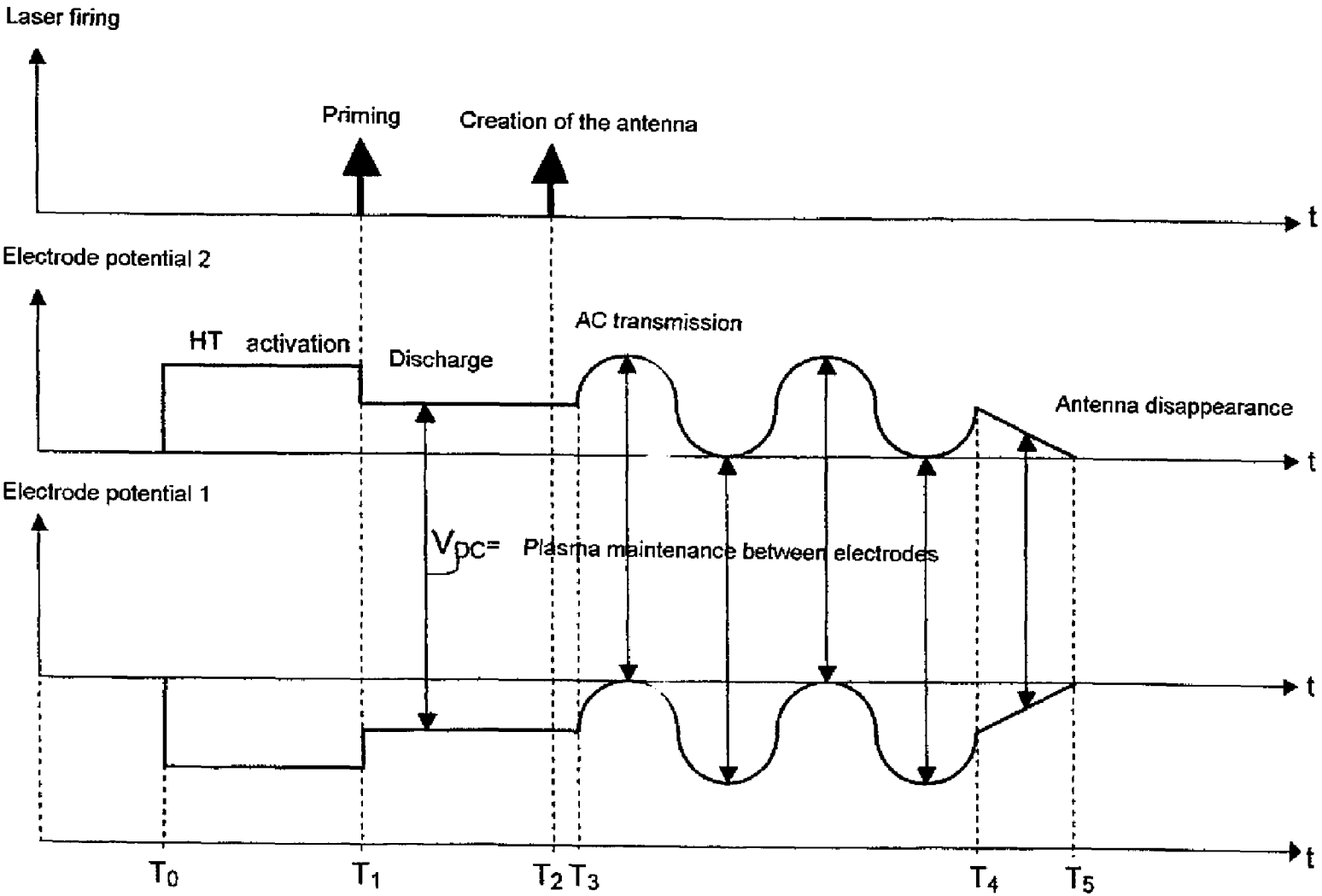
FIG. 9 is a timing chart of a variant of the method of the invention, with two laser firings.

FIG. 6: the transmitter 13 is activated (T3), which injects alternating current power into the "virtual" antenna that is constituted by the plasma columns 17 and 18 and that maintains the ionization of these columns because, as illustrated in FIG. 9, the instantaneous potential difference $V_{DC}$ between the electrodes 1 and 2 is constant from the moment T1 (as explained hereinabove with reference to FIG. 7).

In conclusion, thanks to the device of the invention, in addition to the advantages inherent in the plasma antenna itself, the conductive coupling between the electrodes and the antenna, a very good yield of power transfer is obtained between the generator 13 and the antenna (these electrodes being taken to the same instantaneous alternating current potential, practically all of the alternating current power is injected into the antenna). In addition, this device is very economical, because it requires only one high voltage, low power source.

It will be readily seen by one of ordinary skill in the art that the present invention fulfils all of the objects set forth above. After reading the foregoing specification, one ordinary skill in the art will be able to affect various changes, substitutions of equivalents and various aspects of the invention as broadly disclosed herein. It is therefore intended that the protection granted hereon be limited only by definition contained in the appended claims and equivalents thereof.

The invention claimed is:

1. A device for coupling between a plasma column serving as an antenna and an electric power signal generator, associated with at least one laser, comprising:

at least two conducting electrodes each pierced with a hole, each of the holes being coaxial, the electrodes being connected to a high voltage direct current source and to a power signal alternating current source, each of the at least one laser being placed so that a beam of the at least one laser arrives along the axis of said holes of the electrodes.

2. The device as claimed in claim 1, wherein the at least one laser is a laser of the femtosecond type.

3. The device as claimed in claim 1, comprising, between the two electrodes, a potentiometric assembly in order to fine tune the potentials applied to the two electrodes.

4. A method for using a plasma antenna comprising a coupling device as claimed in claim 1, comprising the following steps:

activating the high voltage source, firing of the at least one laser, creating a plasma between the electrodes and beyond, on the common axis of the holes of the electrodes, and activating the power signal generator up to the end of a transmission period.

5. The method as claimed in claim 4, wherein, between the moment of firing the at least one laser and the activation of the power signal generator, a minimal time of the order of a few tens of nanoseconds is observed.

6. A method for using a plasma antenna comprising a coupling device as claimed in claim 1, comprising the following steps:

activating the high voltage source, first firing of the at least one laser, focused between the electrodes, on the common axis of the holes of the electrodes, and second firing of the at least one laser, focused beyond the second electrode, on the same common axis, activation of the power signal generator up to the end of a transmission period.

* * * * *